US006763640B2

(12) United States Patent
Lane

(10) Patent No.: US 6,763,640 B2
(45) Date of Patent: Jul. 20, 2004

(54) PREFAB BRICKWORK

(76) Inventor: Wallace J. Lane, 536 Riggs Rd., NE., Washington, DC (US) 20011

( * ) Notice: Subject to any disclaimer, the term of this patent is extended or adjusted under 35 U.S.C. 154(b) by 0 days.

(21) Appl. No.: 10/062,670

(22) Filed: Feb. 5, 2002

(65) Prior Publication Data

US 2003/0145543 A1 Aug. 7, 2003

(51) Int. Cl.[7] ..... E04H 12/00; B44F 7/00; E04D 1/00; E04C 3/30

(52) U.S. Cl. ..... 52/300; 52/314; 52/316; 52/555; 52/732.3

(58) Field of Search ..... 52/300, 314, 315, 52/316, 554, 555, 557, 558, 559, 731.4, 732.3, 736.1, 736.3, 301, 296, 424, 425; 256/1, 19, 65.14

(56) References Cited

U.S. PATENT DOCUMENTS

| | | | | | |
|---|---|---|---|---|---|
| 1,416,709 | A | * | 5/1922 | Hahn | 52/281 |
| 2,938,376 | A | * | 5/1960 | Workman | 52/426 |
| 3,089,521 | A | * | 5/1963 | Paiement | 138/158 |
| 3,600,864 | A | | 8/1971 | Godley et al. | |
| 3,646,715 | A | * | 3/1972 | Pope | 52/309.9 |
| 3,768,225 | A | | 10/1973 | Sloan | |
| 3,775,916 | A | | 12/1973 | Bair | |
| 4,107,892 | A | | 8/1978 | Bellem | |
| 4,593,510 | A | * | 6/1986 | Newsome | 52/314 |
| 4,686,807 | A | * | 8/1987 | Newsome | 52/314 |
| 4,811,534 | A | * | 3/1989 | Newsome | 52/219 |
| 5,277,013 | A | | 1/1994 | Gilbert | |
| 5,361,977 | A | * | 11/1994 | Ogrodnick, Jr. | 232/39 |
| 5,501,057 | A | * | 3/1996 | Dawson | 52/761 |
| 5,623,797 | A | * | 4/1997 | Gravier et al. | 52/284 |
| 5,761,861 | A | * | 6/1998 | Brackett | 52/218 |
| 5,794,921 | A | * | 8/1998 | Greenberg | 256/19 |
| 5,836,572 | A | * | 11/1998 | Sugiyama | 256/19 |
| 5,934,035 | A | * | 8/1999 | Rasmussen et al. | 52/300 |
| 5,937,601 | A | * | 8/1999 | McDonald | 52/314 |
| D435,302 | S | | 12/2000 | Blomquist et al. | |
| 6,199,832 | B1 | * | 3/2001 | Morrow | 256/19 |

* cited by examiner

*Primary Examiner*—Carl D. Friedman
*Assistant Examiner*—Kevin McDermott
(74) *Attorney, Agent, or Firm*—Mary Helen Sears

(57) ABSTRACT

Prefabricated, light-weight, columnar or rectangular, convertible to fencing or stand-alone columns resemble solid brick and masonry structures built by skilled masons. Modules comprise heavy duty durable plastic liners with corner reinforcements comprising heavy duty square plastic tubing, faced with concrete, mortar and exterior brick and mortar. Modules are erected on concrete footings equipped with (1) raised studs that mate with square plastic tubing and (2) embedded anchor bolts which mate with bottom apertures. Ends of rectangular modules are bolted together and columnar faces. Capitols are of same plastic faced with concrete or mortar and brick veneer. Black plastic tubing simulating wrought iron may be disposed along wall tops. Module inner spaces may be ballast-filled.

10 Claims, 3 Drawing Sheets

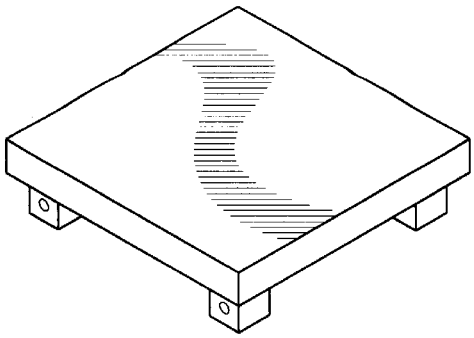
FIG.1A
FIG.1
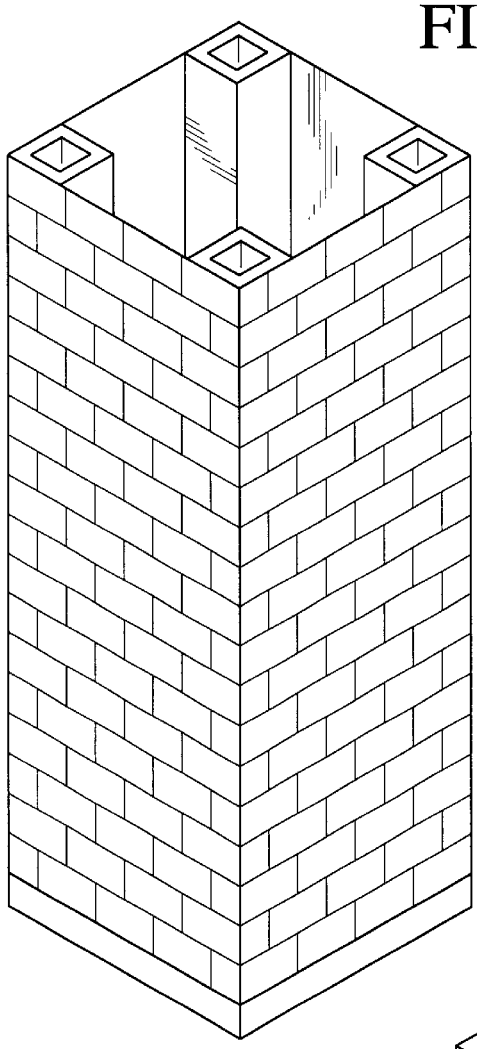
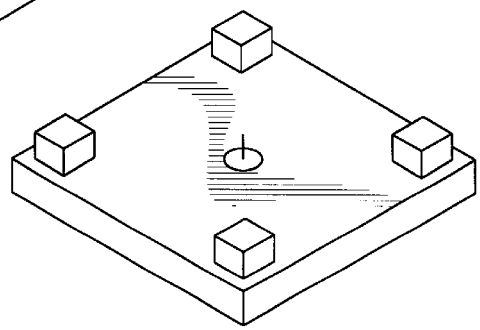
FIG.1B

FIG.2A
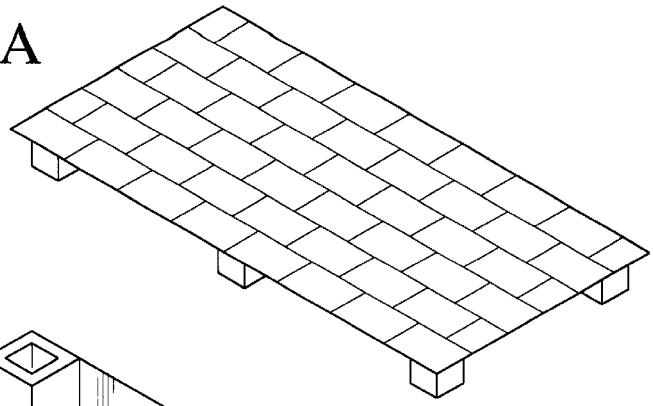
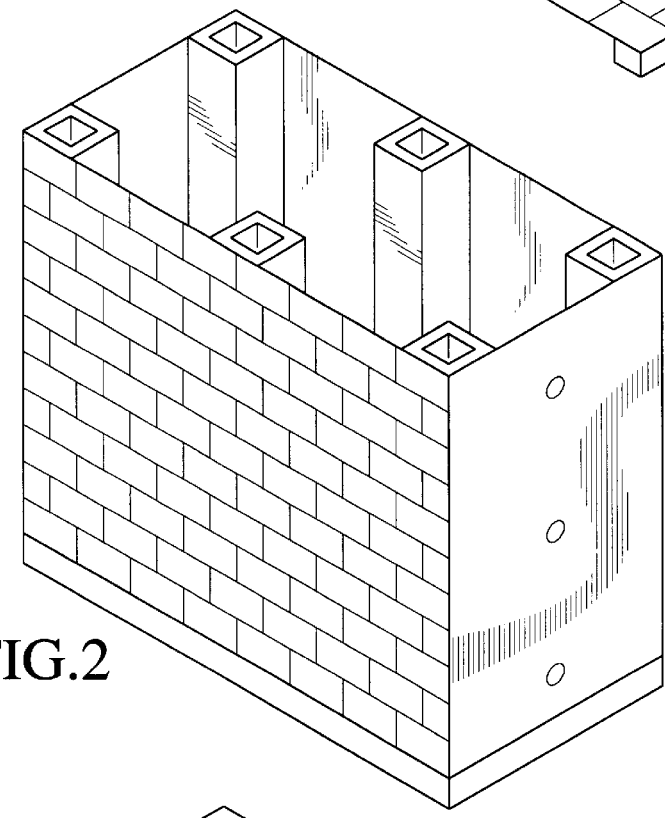
FIG.2
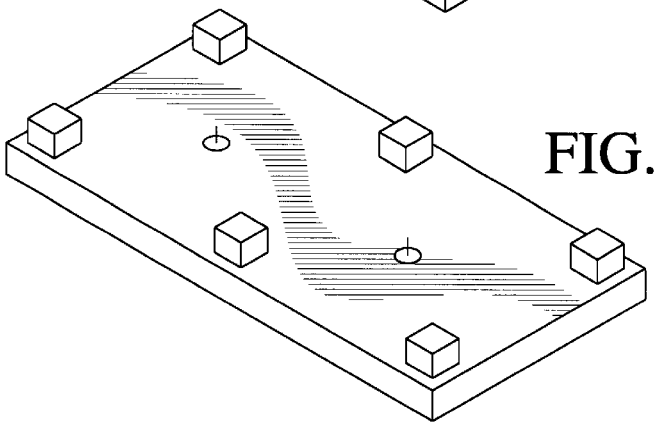
FIG.2B

PREFAB BRICKWORK

The present invention relates to prefabricated brickwork modules especially adapted to be assembled and used as fences in lieu of those constructed of masonry and brick. In particular, such fences of the wall and column type can easily be made with the modules of this invention. This invention also includes the possibility of replacing the wrought iron sections often used to link column and wall sections with lighter weight simulated wrought iron sections fashioned of heavy durable plastic dyed or painted to resemble wrought iron.

BACKGROUND OF THE INVENTION

Brick and masonry fencing is attractive and durable. It is normally very expensive to build because it requires a high level of masonry skill to produce a level square column with even mortar joints, given the massive weight of both the individual sections and the columns. The present invention provides a relatively low cost, light weight alternative which can be installed by persons of far lesser building skills, including, but not limited to, "do it yourself" homeowners.

Moreover, a fence constructed using the modules of this invention can be rapidly assembled and installed in comparison to conventional brick column/wall fencing with or without wrought iron additions.

A number of prior patents describe preformed modules to be used in the exterior walls of a building, especially a light industrial, commercial or residential building of one or two stories. For example, Godley U.S. Pat. No. 3,600,684 describes precast panels having an exterior surface of concrete reinforced by embedding wire mesh therein at the time of casting. For esthetic reasons, the panels are cast against a mold which gives the exterior a pattern of grooves and an uneven texture similar to the appearance of "courses of face brick".

Bair U.S. Pat. No. 3,775,916 describes a prefabricated exterior building wall panel having spaced apart bricks, stones, tiles or other like materials embedded in a cementitious material which simulates mortar and is reinforced by wire mesh embedded in the cementitious material layered behind the embedded bricks, stones, tiles etc. The cementitious layer is backed by an insulating layer which is fastened or otherwise bonded to a "decorative layer" intended to appear as the interior wall surface of the building.

Sloan U.S. Pat. No. 3,768,225 describes a precast masonry wall panel having a concrete core with a facing layer of bricks and mortar on at least the side intended for a building exterior. The concrete core may be cast around metal reinforcing means. It is also contemplated that a facing layer of bricks and mortar may be present on both sides of the concrete core.

Bellem U.S. Pat. No. 4,107,892 describes prefabricated wall units which are joined in an edge-abutting relationship such that each edge is fabricated with a channel and a projecting "wing" at its edge and the placement of the two is alternated so that each "wing" mates with a channel. In each channel, prior to mating, a thermal insulating material, such as a foamed plastic sealant, is placed.

Gilbert U.S. Pat. No. 5,277,013 describes a preformed wall panel and a method for making it. This panel is especially intended for use in the construction of modular buildings of one or two stories on a preformed concrete slab. It comprises a rigid frame, a sheet of exterior finishing material and a sheet of insulating material. In practice, the frame is rigid on all four sides and is attached to the insulation layer, which may be a sheet, e.g. of polystyrene foam. The frame is constructed with slots which automatically provide a dead air space between the insulation and the exterior layer. The exterior layer is preferably a cementitious sheet which may be fiber reinforced. It may also be faced with wood or brick. The interior side is faced with wallboard after the preformed panel has been locked in place on the slab floor.

BRIEF DESCRIPTION OF THE INVENTION

The present invention involves prefabricated brick and mortar faced modules of both columnar and rectangular fence wall shapes that are light in weight and attractive in appearance.

These modules have a heavy duty liner of durable plastic such as high density polyethylene, crystallizable polypropylene or polyvinyl chloride. The plastic is especially selected to be resistant to changes in the acidity of soil and ground water, rain and atmospheric air. The modules are designed to be erected on a concrete footing equipped with a series of raised, square-cross section studs which mate with heavy plastic tubes disposed in the corners of both the columnar and rectangular modules and also at positioned intervals along the longest dimensional sides of the rectangular modules. The concrete footing is also equipped with a series of embedded anchor bolt components which are positioned to mate with holes disposed in the bottoms of the modules, so that when the modules are in place on the footing the anchor bolts, are securely bolted down and, in cooperation with the studs and plastic tubes, they act to maintain proper positioning of the columns and fence sections.

Each prefabricated module is equipped with a capitol of durable plastic which has studs positioned to fit into the plastic tubes and is constructed of the same durable plastic as the tubes. For esthetic purposes the capitol for a column maybe finished on its outside with a facing of concrete to match the base. Rectangular fence sections may be provided with a capitol that is similarly finished, or—especially if simulated wrought iron fencing is to be installed along its top, the capitol for these sections may have an outer veneer of brick and mortar that matches the exterior wall. The ends of the wall sections, which are installed so that they abut one another or a column, are equipped with holes for the placement of additional anchor bolts.

BRIEF DESCRIPTION OF THE DRAWINGS

FIG. 1 depicts a columnar section; while FIG. 1*a* shows a capitol section equipped with pegs which snap into the plastic tubes in the corners of the column and FIG. 1*b* shows a concrete footing equipped with suitable posts which snap into the plastic tubes.

FIG. 2 shows a wall section. FIG. 2*a* shows a brick and mortar faced capitol section for a wall module and FIG. 2*b* shows a base section for a wall module.

DETAILED DESCRIPTION OF THE INVENTION

Figure 3:
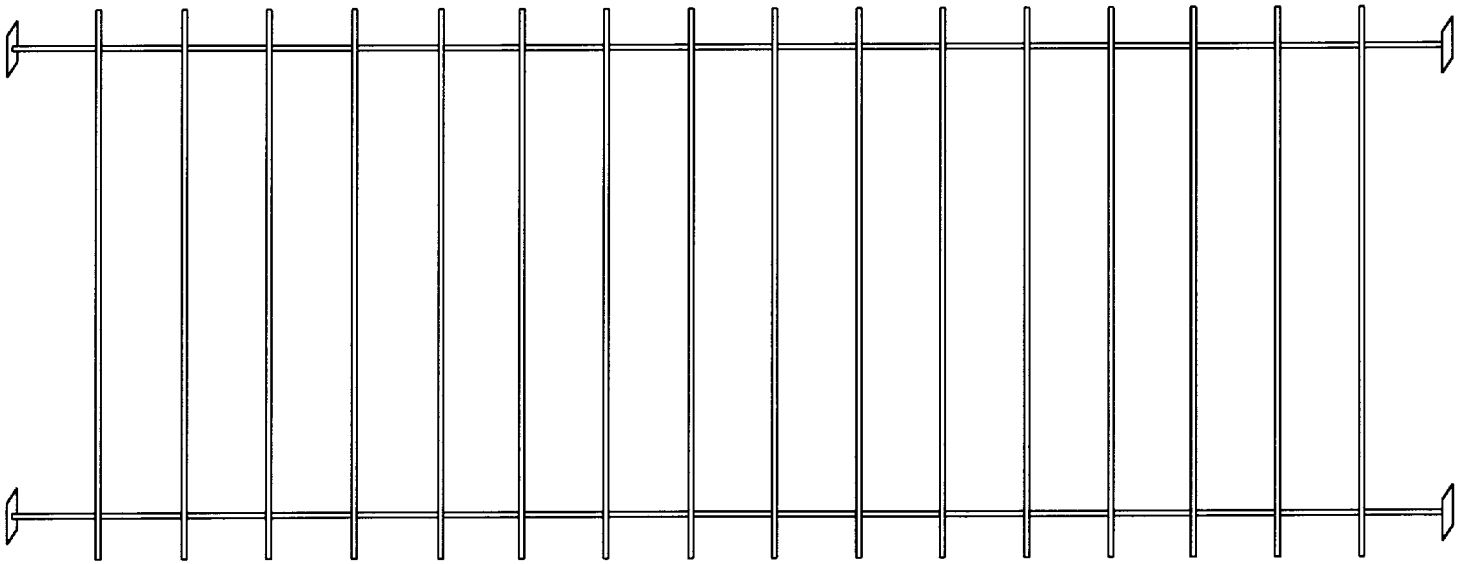
FIG. 3 shows a wrought-iron-like durable plastic section us able as a fence railing.

The units of this invention are particularly designed to be lightweight and low cost while resembling walls and columns that are constructed essentially entirely of brick and mortar.

Both the columnar module of FIG. 1 and the wall module of FIG. 2 are constructed around a durable heavy duty plastic liner selected to be relatively inert to environmental changes such as, e.g., high density polyethylene, crystallizable polypropylene, or polyvinyl chloride. Each module is reinforced at its corners with a section of tubing from the same plastic material. The length of the corner plastic tubing reinforcements coincides with the height of the module.

The modules may be constructed in any desired dimension. Using materials that are currently readily available, it is presently preferred to make both the columnar and wall section modules in 2, 4 or 6 foot heights, with columns supplied in widths of 12½, 17½ or 21 inches and wall section modules in widths of 12 inches. Modules having other dimensions, however, can readily be made without departure from the scope of this invention.

FIG. 1 shows a columnar module with an interior plastic sheet of about 3/16 inch thickness extending around its inner periphery. The column is reinforced with common 4 inch by 4 inch by 1 inch hollow plastic tubing at each of its corners.

A series of ¼ inch wide brick facing has been permanently affixed to the outer face of the inner plastic wall and the appearance of the brick has been enhanced by applying brick mortar to the seams between the bricks.

FIG. 1*a* shows a sheet of 2 inch thick hollow durable plastic cut to the size of the column and placed over a prepared concrete footing to which it is secured with two anchor bolts. In its corners are shown pegs of dimension 2 inches by 2 inches by three inches into which the four plastic corner tubes of the column snap when the unit is assembled.

FIG. 1*b* shows the capitol (or cover) for the columnar module. It is fashioned of durable 2 inch thick plastic and equipped on its under side, at each corner, with the same 2"×2"×3" pegs which snap into the plastic pipe sections in the corners of the column. For esthetic purposes the top side of the capitol is covered with a veneer of cement or concrete.

The columnar sections can be used alone to mark the entrance of a driveway or walk, similarly to the way in which columns constructed of brick and mortar are often presently used. If desired, the capitol for such uses may be topped with any desire ornamental arrangement embedded in cement or mortar. Of course, modules to be so used will be faced with bricks and brick mortar on all four sides. It is within the scope of this invention to use components of other dimensions and materials than those specifically illustrated.

Columnar modules to be used at intervals in a fencing arrangement are provided at appropriate faces with bolt holes that mate with anchor bolts situated in wall section modules; alternatively, the bolts may be carried by the columnar modules and the wall sections may have holes in the faces which mate to one another or to columnar sections. Placement of the bolts or bolt holes in the sides of a wall section module designed to abut another wall section or the side of a columnar module can be seen in FIG. 2, which depicts a typical wall module with 4"×4"×1" hollow plastic tubes at the corners and halfway along its length. The wall sections are typically faced with brick and mortar on the two long sides but left with plastic facing on the short sides intended to abut one another or a column face.

FIG. 2*a* shows a typical wall module footing anchor bolted to a prepared concrete footing and equipped with 2"×2"×3" pegs adapted to snap into the 4"×4"×1" plastic posts of the wall module.

FIG. 2*b* shows a possible capitol for the wall section which is faced at its top side with veneer brick and mortar and has 2"×2"×3" pegs which snap into the tops of the interior plastic posts of the wall module. This capitol is designed for use when a "wrought iron" effect is to be obtained by adding durable black plastic tubing simulating wrought iron, as depicted in FIG. 3, to the top of the wall sections. In instances where this is not desired, a capitol section finished with cement may be used, similar to that shown in FIG. 1*b* but with dimensions and snap-in peg placement on its under surface adapted to accommodate the wall section.

The modules as herein specially described in terms of dimensions represent a presently preferred embodiment; it is envisioned that modules can be built in any desired dimension without departing from the present invention. In addition, while the use of ¼" brick veneer pieces is recommended for facing the preferred embodiments discussed herein, the modules may be faced with, e.g. ½" or even 1-inch or wider brick veneer if desired.

The modules as designed are hollow and of extremely light/weight in comparison to solid brick and mortar fencing. Their light weight is deemed especially advantageous to their use by "do-it-yourself" home owners and the like in building "brick" fencing. It should be recognized, however, that such fencing may not be heavy enough to remain stable in areas where winds of high velocity are common unless it is internally reinforced after installation of the modules and prior to attachment of their capitol portions. More specifically, since the modules have an inner core of air surrounded by heavy duty plastic, they can desired be reinforced by filling that air space with heavier materials that act as ballast. For example, cement or concrete may be poured into the core of each module and allowed to cure, so that it will serve to further anchor each module to the base and to stabilize the module against the effects of heavy winds. The "fill" cement or concrete may be reinforced with wire mesh, pebbles, or any other material that stabilizes and strengthens the interior of the module and in so doing, strengthens the resistance of the fencing to any force that might tend to destroy or displace it in its original lightweight condition. It is noted that even when thus reinforced, the modular fencing is far cheaper and easier to install than solid brick and mortar fencing and has the advantage of being easily and rapidly built by workmen who lack highly honed masonry skills.

Many variations in construction and materials of the modules as herein described will readily occur to those of ordinary skill in the art; it is intended that such variations be encompassed within the scope of the invention as herein described.

What is claimed is:

1. A lightweight square or rectangular module for use in the construction of an outdoor fence or an outdoor gate and post assembly which comprises:

(a) a prefabricated wall section comprising four lateral wall members which are connected to one another to form a square or rectangle having four corners, wherein
  (i) the interior of said wall section is fully lined throughout the length, breadth and height thereof with a liner of solid heavy duty plastic,
  (ii) each of the four corners of said square or rectangle is reinforced with a tubular member fashioned of solid heavy duty plastic tubing of the same height as said wall section,
  (iii) said plastic liner surrounds a cavity filled with air and
  (iv) at least one exterior side of said wall section is faced with a material selected from the group consisting of brick and mortar, concrete and cement, (b) a separate square or rectangular capitol member having the same length and breadth dimensions as said wall section, which member is
  (i) comprised of solid heavy duty plastic,
  (ii) is equipped at each of the four corners thereof with a snap-in stud or peg positioned to fit into and mate with a correspondingly located tubular member of said wall section, and (iii) is faced with a material selected from the group consisting of brick and mortar, concrete and cement, and (c) a square or rectangular bottom member of the same length and breadth dimensions as said wall section, which bottom member (i) is comprised of solid heavy duty plastic, (ii) has a through hole positioned at each of its four corners to fit over the tubular member in each corner of said wall section, thereby leaving the bottom end of each said tubular member available to snap into and mate with a snap-in peg or stud preset in a separate cement or concrete footing member that has been preformed in the earth, and (iii) contains at least one bolt hole for fitting over at least one anchor bolt preset in said cement or concrete footing member.

2. A lightweight rectangular module as defined in claim 1 wherein the prefabricated wall section comprises four lateral wall members of the same height, two of the wall members have the same length and the other two of the wall members have a common length longer than that of the first two, and said four lateral wall members are assembled so that the longer two members are parallel to and opposite each other, thereby forming a rectangle having four corners, wherein (a) at least one additional tubular member of the same height as the four wall members is disposed along the inner surface of each of said two longer wall members at locations directly opposite one another and spaced from the two corners of said module that are located to the right and left of said at least one tubular member on each side of said rectangle, (b) the separate capitol member is rectangular and of the same length and breadth dimensions as said wall section, and is fitted with correspondingly located snap-in pegs or studs so positioned as to snap into and mate, when the module is assembled, with each said at least one additional tubular member along the inner surface of each of the two longer wall members, and (c) the rectangular bottom of the same length and breadth as said wall section is fitted with additional through holes positioned to fit over at least one additional tubular member on each side of the rectangle, leaving the ends of each said at least one additional tubular member along the inner surface of each of the two longer wall members free to snap into and mate with a correspondingly located snap-in peg or stud preset in the cement or concrete footing member preformed in the earth.

3. A lightweight rectangular module as defined in claim 2 wherein the exterior surfaces of each of said longer two wall members of the wall section are faced with brick and mortar and the exterior surfaces of each of the remaining two wall members are faced with cement and are each fitted with hardware for anchor bolting said rectangular module to a cement covered exterior surface of the wall section of another square or rectangular module.

4. A lightweight rectangular module as defined in claim 2 wherein the exterior surfaces of each of said longer two wall members of the wall section are faced with brick and mortar, said solid heavy duty plastic liner is at least two inches thick and the other two exterior surfaces of the wall section are left unfaced and are each fitted with hardware for anchor bolting said rectangular module to the unfaced exterior surfaces of another square or rectangular module.

5. A lightweight square module as defined in claim 1 wherein the exterior surfaces of all four sides of said wall section are faced with brick and mortar.

6. A lightweight square module as defined in claim 1, wherein three adjacent lateral surfaces of said wall section are faced with brick and mortar and the fourth exterior lateral surface of said wall section is either faced with cement, or is lined with a solid heavy duty plastic liner that is at least two inches thick and is left unfaced, and said fourth exterior lateral surface is further fitted with hardware for anchor bolting said module either to a cement-covered exterior surface of the wall section of another module or to an unfaced exterior surface of another module having a solid heavy duty plastic liner that is at least two inches thick.

7. A lightweight square module as defined in claim 1 wherein two adjacent exterior surfaces of said wall section are faced with brick and mortar and the remaining two exterior surfaces of said wall section (i) are either faced with cement or are lined with a solid heavy duty plastic liner that is at least two inches thick and are left unfaced, and (ii) in either instance, are each fitted with hardware for anchor bolting to either a cement covered exterior surface, or an unfaced exterior surface, of another module.

8. A lightweight square or rectangular module as defined in claim 1 wherein the facing material on all exterior surfaces of said wall section and said capitol member is of a thickness between about one inch and about ¼ inch.

9. A lightweight square module according to claim 1 wherein two opposite exterior faces of said wall section are faced with brick and mortar and the two remaining opposite exterior faces of said wall section (i) are either faced with cement or are lined with a solid heavy duty plastic liner that is at least two inches thick and left unfaced and (ii) in either instance, are each fitted with hardware for bolting to either a cement covered exterior surface, or an unfaced exterior surface, of another module.

10. A module as defined in claim 1 wherein a ballast material is placed in the interior cavity of said wall section after the latter has been fastened to said separate cement or concrete footing member by snapping its tubular members into and mating them with the preset snap-in pegs or studs of said footing member and bolting said wall section through said at least one bolt hole in the bottom thereof to said footing member with the at least one anchor bolt set in said footing member, but prior to attaching said separate capitol member to said wall section.

* * * * *